US006484009B2

(12) United States Patent
Furuya et al.

(10) Patent No.: US 6,484,009 B2
(45) Date of Patent: Nov. 19, 2002

(54) ELECTROPHOTOGRAPHIC PRINTER HAVING OFFSET PREVENTION

(75) Inventors: Satoru Furuya, Tokyo (JP); Yukifumi Ito, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 09/881,202

(22) Filed: Jun. 15, 2001

(65) Prior Publication Data

US 2002/0034409 A1 Mar. 21, 2002

(30) Foreign Application Priority Data

Jun. 20, 2000 (JP) ..... 2000-184311
Jun. 8, 2001 (JP) ..... 2001-173911

(51) Int. Cl.[7] ..... G03G 15/20

(52) U.S. Cl. ..... 399/333; 219/216; 219/469; 399/44; 399/324; 399/341

(58) Field of Search ..... 399/333, 330, 399/331, 328, 324, 341, 44, 97, 406; 219/216, 469; 118/60; 432/60; 492/46, 49, 50, 53, 56

(56) References Cited

U.S. PATENT DOCUMENTS

| | | | | |
|---|---|---|---|---|
| 3,826,379 A | | 7/1974 | Wright | 271/208 |
| 4,645,327 A | * | 2/1987 | Kimura et al. | 399/97 |
| 5,045,891 A | * | 9/1991 | Senba et al. | 399/331 |
| 5,253,024 A | * | 10/1993 | Okuda et al. | 399/324 |
| 5,850,589 A | * | 12/1998 | Cruz et al. | 399/341 |
| 6,173,151 B1 | * | 1/2001 | Ream et al. | 399/324 |
| 6,192,213 B1 | * | 2/2001 | Wada et al. | 399/341 X |

FOREIGN PATENT DOCUMENTS

| | | | |
|---|---|---|---|
| EP | 63192071 | | 8/1988 |
| EP | 4036975 A1 | | 5/1991 |
| EP | 03239276 | | 10/1991 |
| EP | 03239277 | | 10/1991 |
| EP | 0726506 A | | 8/1996 |
| JP | 57076576 | | 5/1982 |
| JP | 60128461 | | 7/1985 |
| JP | 09026732 | | 1/1997 |
| JP | 10-274898 | * | 10/1998 |
| JP | 2000-131983 | * | 5/2000 |

* cited by examiner

*Primary Examiner*—Sophia S. Chen
(74) *Attorney, Agent, or Firm*—Rabin & Berdo, P.C.

(57) ABSTRACT

An electrophotographic printer has neutralizing units and a fixing unit that are disposed in the transport path of a print medium. The neutralizing units neutralize a toner image surface of the print medium entering the fixing unit and a non-printed surface of the print medium exiting the fixing unit. The fixing unit includes two rollers. A fixing roller incorporates a heat source that generates heat for fusing a toner image on the print medium. A pressure roller is in pressure engagement with the fixing roller. At least one of the fixing roller and pressure roller includes a resilient member that covers a metal shaft and an insulation layer that covers the resilient member. The resilient member may contain electrically conductive whiskers that extend radially in three dimensions. The whiskers are dispersed such that a surface of the insulation layer and a surface of the shaft are electrically continuous.

20 Claims, 12 Drawing Sheets

FIG.10

| R.H. (%) | 20 | 22.5 | 25 | | 77.5 | 80 |
|---|---|---|---|---|---|---|
| TEMP. (℃) | | | | | | |
| 0 | 0.750 | 0.844 | 0.938 | | 2.917 | 3.011 |
| 1 | 0.806 | 0.907 | 1.008 | | 3.137 | 3.238 |
| 2 | 0.867 | 0.975 | 1.084 | | 3.371 | 3.481 |
| 3 | 0.931 | 1.047 | 1.164 | | 3.622 | 3.739 |
| 4 | 0.999 | 1.124 | 1.249 | | 3.888 | 4.015 |
| 5 | 1.071 | 1.206 | 1.340 | | 4.172 | 4.308 |
| 6 | 1.149 | 1.292 | 1.436 | | 4.475 | 4.620 |
| 7 | 1.231 | 1.385 | 1.539 | | 4.796 | 4.952 |
| 8 | 1.318 | 1.483 | 1.648 | | 5.138 | 5.305 |
| 9 | 1.411 | 1.587 | 1.764 | | 5.502 | 5.681 |
| 10 | 1.509 | 1.698 | 1.887 | | 5.889 | 6.080 |
| 11 | 1.613 | 1.816 | 2.018 | | 6.299 | 6.505 |
| 12 | 1.724 | 1.940 | 2.157 | | 6.735 | 6.955 |
| 13 | 1.842 | 2.073 | 2.304 | | 7.198 | 7.433 |
| 14 | 1.966 | 2.213 | 2.460 | | 7.689 | 7.940 |
| 15 | 2.098 | 2.361 | 2.625 | | 8.209 | 8.477 |
| 16 | 2.237 | 2.518 | 2.799 | | 8.760 | 9.047 |
| 17 | 2.385 | 2.684 | 2.984 | | 9.345 | 9.651 |
| 18 | 2.541 | 2.860 | 3.180 | | 9.964 | 10.291 |
| 19 | 2.706 | 3.046 | 3.386 | | 10.620 | 10.968 |
| 20 | 2.881 | 3.243 | 3.605 | | 11.313 | 11.685 |
| 21 | 3.065 | 3.450 | 3.836 | | 12.048 | 12.444 |
| 22 | 3.260 | 3.669 | 4.080 | | 12.824 | 13.247 |
| 23 | 3.465 | 3.901 | 4.337 | | 13.645 | 14.095 |
| 24 | 3.682 | 4.145 | 4.609 | | 14.513 | 14.993 |
| 25 | 3.910 | 4.402 | 4.895 | | 15.431 | 15.941 |
| 26 | 4.151 | 4.674 | 5.197 | | 16.400 | 16.943 |
| 27 | 4.405 | 4.960 | 5.516 | | 17.423 | 18.002 |
| 28 | 4.672 | 5.261 | 5.851 | | 18.505 | 19.120 |
| 29 | 4.954 | 5.578 | 6.204 | | 19.645 | 20.300 |
| 30 | 5.250 | 5.912 | 6.576 | | 20.850 | 21.546 |

UNIT : g／$m^3$

ELECTROPHOTOGRAPHIC PRINTER HAVING OFFSET PREVENTION

BACKGROUND OF THE INVENTION

1. Field of the Invention

The present invention relates to an electrophotographic printer in which toner is prevented from migrating from a print medium to a heat roller of a fixing unit during fixing operation.

2. Description of the Related Art

FIG. 11 illustrates a relevant portion of a conventional electrophotographic printer.

FIG. 12 illustrates a mechanism in which a toner image formed on a photoconductive drum is transferred onto a print medium.

Referring to FIG. 11, the conventional electrophotographic printer has a charging roller 12, an LED head 13, a developing unit 14, a transfer roller 15, and a cleaning roller 17, all of which being disposed around a photoconductive drum 11. These structural elements are disposed in the order in which a photographic process is carried out.

A print medium P travels in a direction shown by arrow A. The transfer roller 15 is disposed under the photoconductive drum 11 and rotates in contact with the photoconductive drum 11, thereby defining a transfer section through which the print medium passes during printing. When the print medium P passes the transfer section, a toner image is transferred from the photoconductive drum 11 onto the print medium P. The charging roller 12 and cleaning roller 17 are disposed downstream of the transfer section with respect to the rotation of photoconductive drum 11. The LED head 13 is disposed above the photoconductive drum 11. The developing unit 14 is disposed upstream of the transfer section with respect to the rotation of the photoconductive drum.

There is provided an endless belt 10 that is entrained about rollers, not shown, and is sandwiched between the photoconductive drums 11 and transfer rollers 15. The endless belt 10 runs in the direction shown by arrow A. The endless belt 10 attracts the print medium P that is fed from a paper cassette, not shown, and transports the print medium P along a transport path from an upstream end to a downstream end of the transport path.

The charging roller 12 uniformly charges the surface of the photoconductive drum 11. An LED array, not shown, of the LED head 13 is selectively energized in accordance with print data to illuminate the surface of the charged photoconductive drum 11 to form an electrostatic latent image on the photoconductive drum 11.

In the developing unit 14, a sponge roller **14*b* supplies toner to a developing roller 14*a*. A developing blade 14*c* is in contact with the rotating developing roller 14*a* to form a uniform thin layer of toner on the surface of the developing roller 14*a*. The developing roller 14*a* rotates in contact with the photoconductive drum 11, thereby depositing negatively charged toner on the latent image formed on the photoconductive drum 11** to form a toner image.

The transfer roller 15 is connected to a high voltage power supply 16 which applies a potential in the range of several hundred volts to several thousand volts across the photoconductive drum 11 and the transfer roller 15, so that the toner T on the photoconductive drum 11 migrates from the photoconductive drum 11 to the print medium P that is transported by the endless belt 10 between the photoconductive drum 11 and the transfer roller 15.

As shown in FIG. 12, dielectric polarization occurs such that toner image-receiving surface of the print medium P is positively charged. When the negatively charged toner T on the photoconductive drum 11 is brought into contact with the positively charged surface of the print medium P, the negatively charged toner T is attracted by the Coulomb force to the positively charged surface of the print medium P. In other words, the toner image is transferred onto the print medium P. A current flows through the print medium P between the print medium P and non-exposed areas, i.e., areas on the photoconductive drum 11 in which no toner exists, so that the residual charges are neutralized. Thus, the toner image-receiving surface of the print medium P is generally negatively charged. The toner transferred onto the print medium P remains attracted to the print medium by weak Coulomb force.

The cleaning roller 17 shown in FIG. 11 removes the toner that remains on the photoconductive drum 11 after transferring.

A neutralizing brush 18 is provided in the transport path of print medium downstream of the transfer section. The free end of the neutralizing brush 18 is in contact with the non-printed surface of the print medium P in order to neutralize the charges deposited on the non-printed surface of the print medium P. The base portion of the neutralizing brush 18 is grounded.

Downstream of the neutralizing brush 18, there is provided a fixing unit 19 that includes a fixing roller **19*a* and a pressure roller 19*b*. The fixing roller 19*a* has a heat source, not shown, that supplies heat to the surface of the print medium onto which the toner image has been transferred. The pressure roller 19*b* is disposed under the fixing roller 19*a* and presses the print medium P against the fixing roller 19*a***.

The heat supplied from the fixing roller **19*a* fuses the toner deposited on the print medium and the pressure applied by the pressure roller 19*b* causes the fused tone to penetrate the print medium P. The fixing roller 19*a* and pressure roller 19*b*** have insulating layers formed thereon such that the toner is easily peeled off therefrom.

With the aforementioned conventional electrophotographic printer, the surfaces of the fixing roller **19*a* and pressure roller 19*b*** are covered with insulation that facilitates the peeling off of toner. However, the conventional printer suffers from the "offset" problem, i.e., an unintentional or faulty transfer of toner from a print medium to the fixing roller in contact with the print medium.

If the offset problem occurs, the toner deposited on the fixing roller **19*a* is then deposited to the pressure roller 19*b*** and/or other parts of the print medium. The toner may also be deposited on the following page of print medium such that a ghost image may appear on the following page or the page is simply soiled.

The offset problem will occur if the negative potential on the toner image surface of the print medium P and the positive potential on the non-toner image surface are excessively high when the print medium P passes the fixing unit. For a tandem type color printer, the yellow, magenta, cyan, and black toner images are formed on the print medium attracted to the transport belt. Thus, the potential of the toner image surface of the print medium is apt to be higher for a tandem type color printer than for a monochrome printer. Especially, in a low temperature and low humidity environment, the impedance of the print medium is high and therefore the both opposed surfaces of the print medium tend to be high potential.

The surface of the print medium on which a toner image has not been transferred is easily neutralized by the neutralizing brush 18, the frame or chassis of the printer body. However, the charges on the toner-image surface of the print medium and the non-toner image surface are opposite in polarity and are in equilibrium. Thus, it is very difficult to completely neutralize the charges on the both surfaces of the print medium.

If the negative potential on the toner image surface of the print medium and the positive potential on the non-toner image surface are excessively high, when the print medium P is brought into contact with the fixing roller 19*a*, a potential difference will develop between the fixing roller 19*a* and the print medium P, creating an electric field therebetween. The electric field causes the negatively charged toner on the toner image surface of the print medium to migrate to the fixing roller 19*a*, thereby resulting in the offset problem.

SUMMARY OF THE INVENTION

An object of the present invention is to provide an electrophotographic printer in which the offset problem of a fixing unit is effectively prevented.

Another object of the present invention is to provide an electrophotographic printer in which the charges deposited on the print medium after transfer are promptly neutralized.

An electrophotographic printer according to the invention incorporates a fixing unit. The fixing unit includes a fixing roller and a pressure roller. The fixing roller has a heat source that generates heat for fusing a toner image transferred by a transfer unit onto a print medium. The pressure roller is in pressure engagement with the fixing roller. At least one of the fixing roller and the pressure roller includes a resilient member that covers a metal shaft and an insulation layer that covers the resilient member. The resilient member contains electrically conductive whiskers that extend radially in three dimensions. The whiskers are dispersed such that a surface of the insulation layer and a surface of the shaft are electrically continuous.

The electrophotographic printer may further include a neutralizing brush that is disposed downstream of the fixing unit in proximity to the fixing unit. The neutralizing brush neutralizes a first surface of the print medium on which the toner image is transferred.

The electrophotographic printer may include a neutralizing roller instead of the neutralizing brush. The neutralizing roller is disposed downstream of the fixing unit and neutralizes a first surface of the print medium on which the toner image is transferred.

The electrophotographic printer may include a metal rod that has a sharp point and is disposed downstream of the transfer unit. When the print medium advances from the transfer unit to the fixing unit, the sharp point is in proximity to a first surface of the print medium to neutralize an excessive charge deposited thereon, the first surface being a surface on which the toner image is transferred.

The electrophotographic printer may further include:

moisture detector that detects a moisture in the air;

moisture calculator that determines an amount of moisture that should be given to the print medium;

a humidifier disposed downstream of the transfer unit and upstream of the fixing unit, the humidifier applying an amount of moisture calculated by the moisture calculator to a second surface of the print medium opposite to a first image on which a toner image is transferred.

Another electrophotographic printer according to the invention incorporates a fixing unit and a neutralizing unit disposed in a transport path of a print medium. The fixing unit includes a fixing roller and a pressure roller. The fixing roller has a heat source that generates heat for fusing a toner image transferred onto a print medium. The pressure roller is in pressure engagement with the fixing roller to form a nip between the fixing roller and the pressure roller. The neutralizing unit is disposed downstream of the fixing unit and neutralizes a charged surface of the print medium discharged from the fixing unit.

The neutralizing unit is disposed to oppose a first surface of the print medium on which the toner image is transferred.

The neutralizing unit is a neutralizing brush.

The neutralizing unit is a neutralizing roller.

Another neutralizing unit may be disposed upstream of the fixing unit and downstream of a transfer section. The another neutralizing unit is disposed to oppose a second surface of the print medium opposite to the first surface.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein:

FIG. 10 is a table that list moisture in the air for various temperature and humidity;

DETAILED DESCRIPTION OF THE INVENTION

Embodiments of the invention will be described in detail with reference to the accompanying drawings.

First Embodiment

In the specification, the term toner image surface is used to cover a surface of a print medium on which a toner image is carried when the print medium enters a fixing unit. The term non-toner image surface is used to cover a surface of the print medium on which a toner image is not carried when the print medium enters the fixing unit. The toner image surface is a surface opposite to the non-toner image surface.

Figure 1:
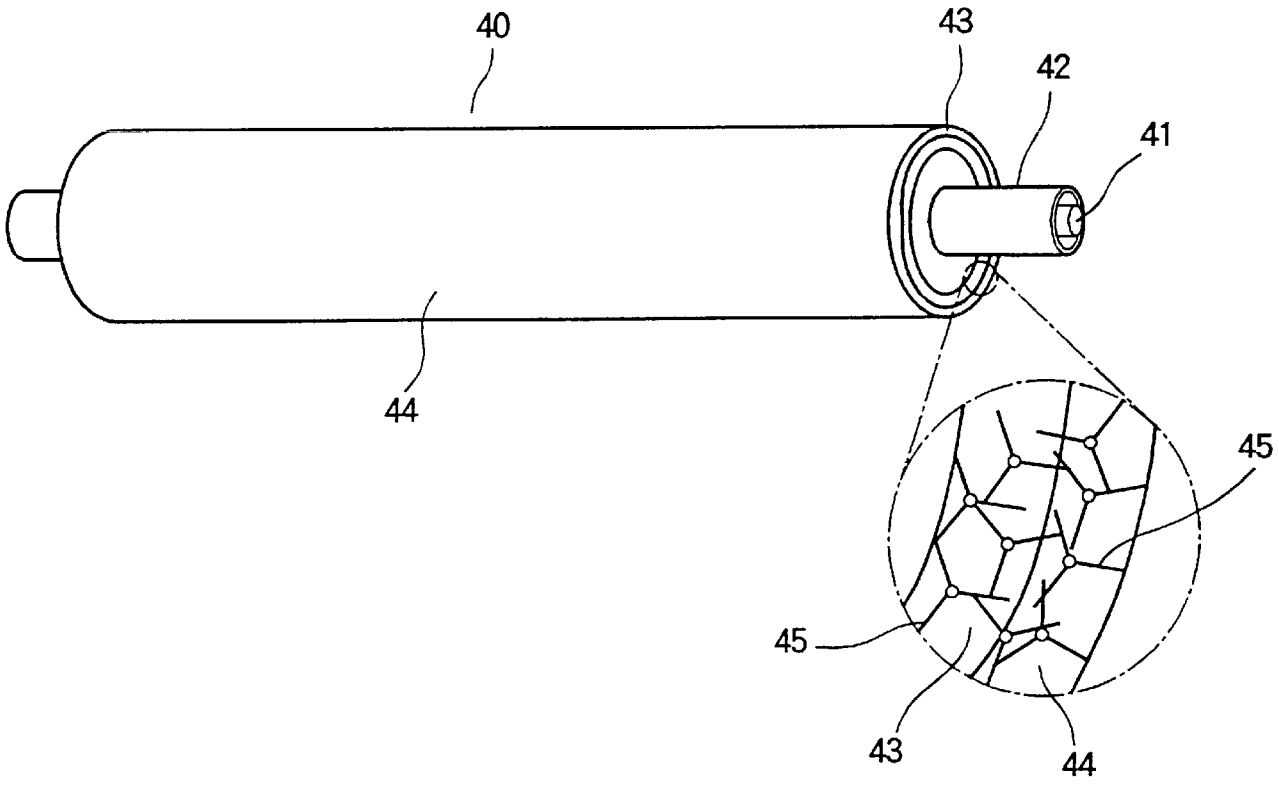
FIG. 1 illustrates a configuration of a first embodiment of a fixing roller according to the present invention.

FIG. 1 illustrates a configuration of a first embodiment of a fixing roller according to the present invention.

Figure 2:
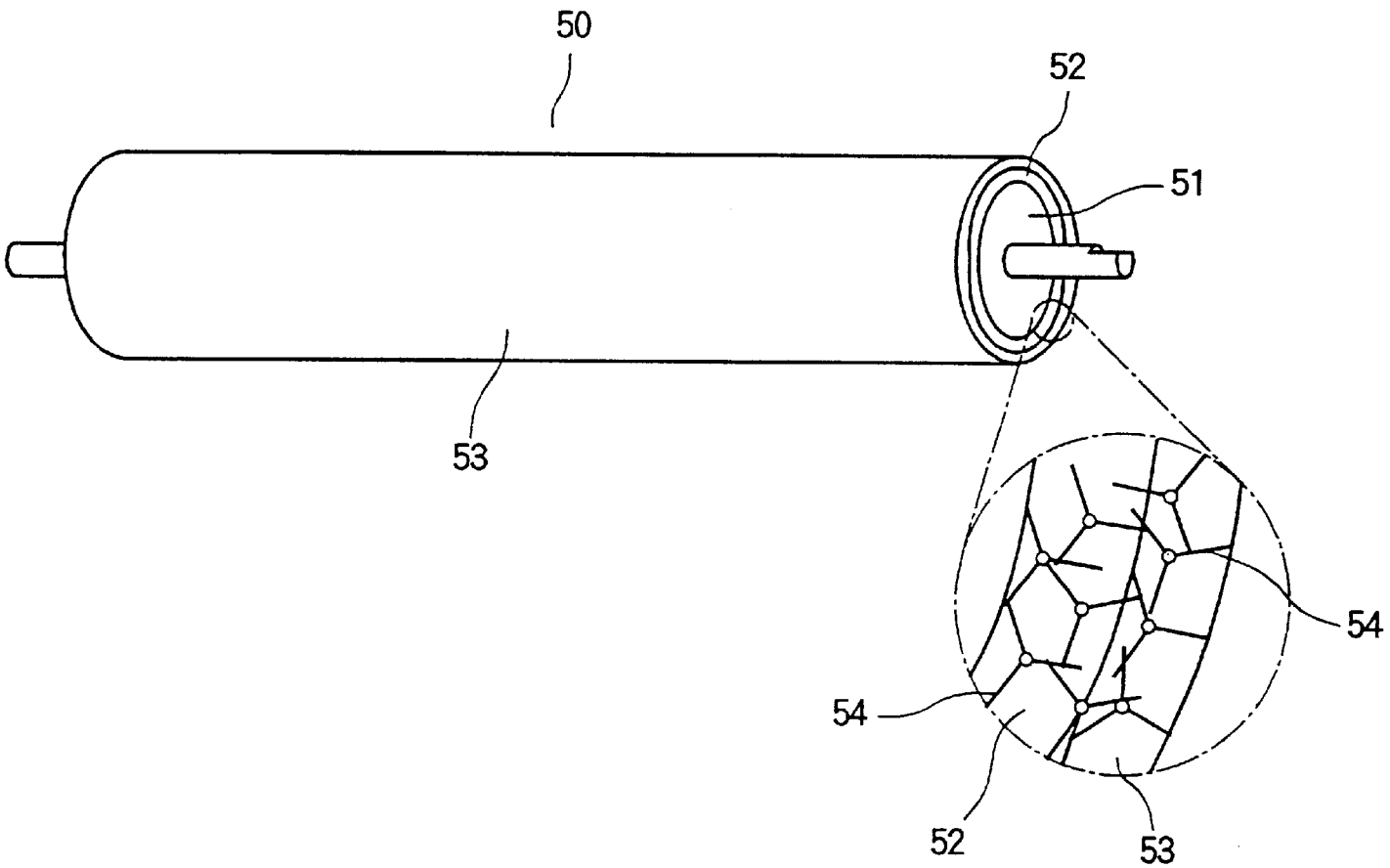
FIG. 2 illustrates a configuration of a pressure roller of the first embodiment.

FIG. 2 illustrates a configuration of a pressure roller of the first embodiment.

Figure 3:
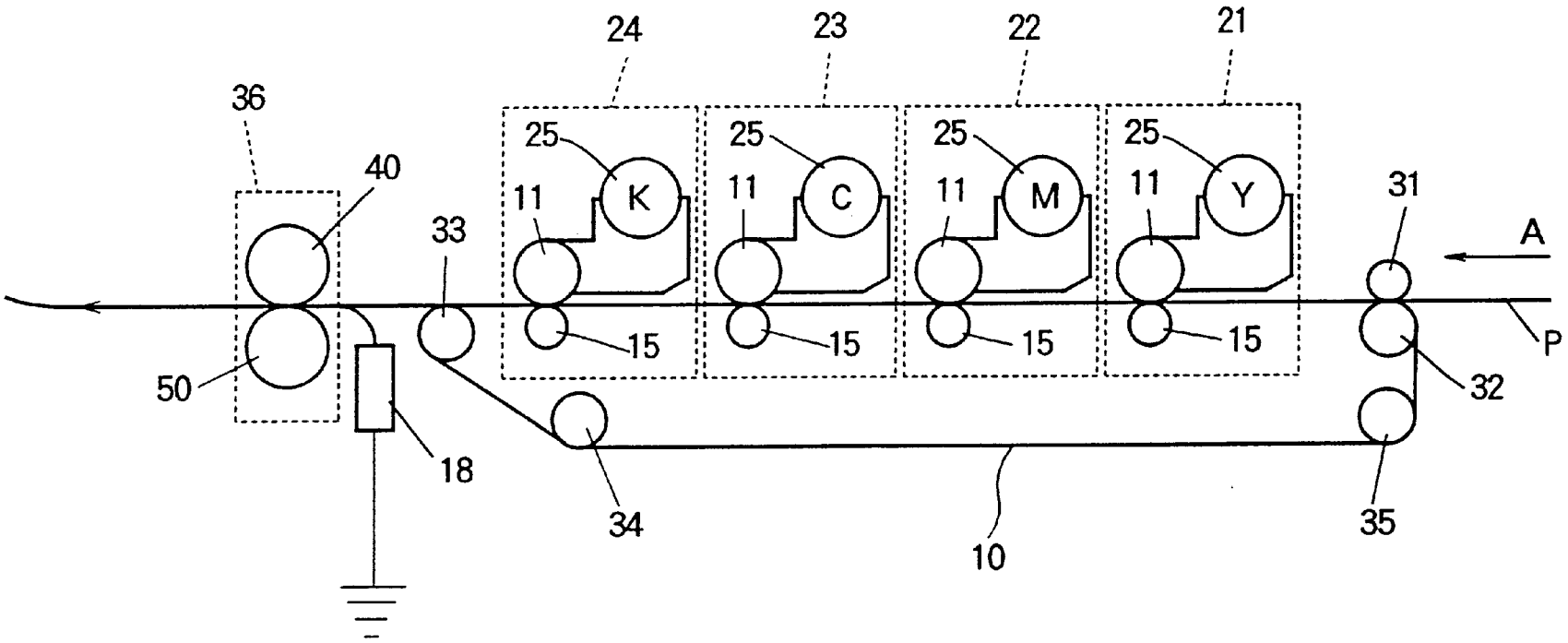
FIG. 3 illustrates a pertinent portion of an electrophotographic printer of the first embodiment.

FIG. 3 illustrates a pertinent portion of an electrophotographic printer of the first embodiment.

Referring to FIG. 3, the electrophotographic printer according to the first embodiment is of a tandem type color printer. The color printer includes image-forming sections 21, 22, 23, and 24 for yellow, magenta, cyan, and black images. The image-forming sections 21, 22, 23, and 24 are disposed along a path of a print medium P indicated by arrow A and operate to print the images on the print medium P supplied from a paper cassette, not shown.

The image-forming sections 21, 22, 23, and 24 each include an LED (light emitting diode) type exposing unit. The image-forming section is an integral unit that takes the form of an image drum cartridge 25. The image drum cartridge 25 includes a charging unit, a developing unit, and a cleaning unit, and can be replaced on a cartridge basis. The image-forming section carries out an electrophotographic process: charging, exposing, developing and transferring.

A transport belt 10 is entrained about an attraction roller 32, drive roller 33, tension roller 34, and driven roller 35, and runs in the direction shown by arrow A between the photoconductive drums 11 and the transfer rollers 15. Another attraction roller 31 is disposed over the attraction roller 32 such that the transport belt 10 is sandwiched between the attraction rollers 31 and 32.

A potential difference exists between the attraction rollers 31 and 32. The potential difference creates dielectric polarization in the print medium P that is transported on the transport belt 10. The dielectric polarization produces an electrostatic force so that the transport belt 10 attracts the print medium P. The transport belt 10 carries the print medium P thereon, passing through the transfer sections defined between the photoconductive drums 11 and the transfer rollers 15 of the respective image-forming sections. As the print medium P passes through the transfer sections, the toner images of the respective colors are transferred one over the other onto the print medium P in sequence.

The transport belt 10 is made of, for example, a high resistance semiconductive plastic film. The resistance of the transport belt 10 is selected such that the transport belt 10 is charged to sufficiently attract the print medium P and neutralized by itself after the print medium P has left the transport belt 10.

When the print medium P reaches the drive roller 33, the transport belt 10 releases the print medium P. There is provided a neutralizing device, not shown, above the drive roller 33. The neutralizing device neutralizes the print medium P so that the print medium P is no longer electrostatically attracted to the transport belt 10 but is separated from the transport belt 10.

A neutralizing brush 18 is disposed downstream of the drive roller 33 in the transport path of the print medium P. The neutralizing brush 18 has a base portion that is grounded and a free end that contacts the non-toner image surface of the print medium P to dissipate charges on the non-toner image surface.

A fixing unit 36 is located downstream of the neutralizing brush 18 and includes a fixing roller 40 and a pressure roller 50. The fixing roller 40 supplies heat to the toner image on the print medium P. The pressure roller 50 is under the fixing roller 40 to oppose the fixing roller 40 such that the toner-image surface of the print medium P fed between pressure roller 50 and the fixing roller 40 is pressed against the fixing roller 40.

The toner images of the respective colors on the print medium P are fused by the heat supplied from the fixing roller 40, and the pressure roller 50 causes the fused toner to penetrate the print medium P, so that the toner images are fixed. Thereafter, the print medium P is discharged into a stacker, not shown.

The construction of the fixing roller 40 will be described with reference to FIG. 1.

Referring to FIG. 1, the fixing roller 40 incorporates a heater 41 in the middle thereof. The heater 41 is accommodated in a metal pipe 42 that has an inner circumferential surface in proximity to the heater 41 and one longitudinal end connected to the ground, not shown. The heater 41 may be provided on an outside surface of the metal pipe 42. The metal pipe 42 is covered with a resilient member 43 whose surface is covered with an insulation layer 44. The resilient material 43 is made of a rubber material such as silicone rubber and fluoro rubber. The insulation layer 44 is formed of an insulation material having a very low electrical conductivity, for example, fluororesin such as PFA (tetrafluoroethylene/perfluoroalxylvinylether).

Whiskers 45 made of zinc oxide are in the shape of a tetrapod that has legs extending in three dimensions. The whiskers 45 are electrically conductive and dispersed in the resilient member 43 such that the surface of the fixing roller 40 is electrically continuous to the metal pipe 42. The whiskers 45 are dispersed randomly on the surface of the insulation layer 44, thereby maintaining the metal pipe 42 and the entire surface of the fixing roller 40 at the same potential. In the first embodiment, the whisker 45 is not limited to the shape of a tetrapod but can be of any shape that extends in three dimensions.

Regular tetrahedrons, defined by four vertexes of the whisker 45, should preferably fill the resilient member 43 uniformly, so that the electrical conductivity between the surface of the fixing roller 40 and the metal pipe 42 is uniform across the length of the fixing roller 40.

A preferable number of whiskers 45 is in the range of $1\times10^{10}\times V$ to $1\times10^{20}\times V$, and more preferably in the range of $1.6\times10^{13}\times V$ to $2.4\times10^{17}\times V$, provided that the resilient member 43 has a volume of V. The number of whiskers 45 required for filling the entire resilient member 43 and insulation layer 44 can be calculated as follows:

A length a of legs of the whisker is equal to the distance between the center of gravity of the tetrahedron and the vertex of the tetrahedron. The height and edge of the tetrahedron is given by $$\frac{4}{3}a \text{ and } \frac{2}{3}\sqrt{6}\,a,$$

respectively. The height of a triangle that defines the base of the tetrahedron is given by $\sqrt{2}\alpha$. Thus, the area of the base can be calculated by $$\frac{2}{3}\sqrt{6}\,a\times\sqrt{2}\,a\times\frac{1}{2}=\frac{2}{3}\sqrt{3}\,a^2 \text{ and}$$

and therefore the volume of the tetrahedron is obtained by $$\frac{2}{3}\sqrt{3}\,a^2\times\frac{4}{3}a\times\frac{1}{3}=\frac{8}{27}\sqrt{3}\,a^3.$$

The number n of whiskers that fill the entire resilient member 43 and insulation layer 44 is given by $$n=\frac{9}{8}\sqrt{3}\times(V/a^3).$$

The length a of fibers of the whisker 45 varies from 2 to 50 $\mu$m. A length of fiber of 2 $\mu$m provides an optimum value of $2.4\times10^{17}\times V$. A length of fiber of 50 $\mu$m provides an optimum value of $1.6\times10^{13}\times V$. The range of $1\times10^{10}\times V$ to $1\times10^{20}\times V$ is an acceptable range taking into consideration variation in the amount of whisker 45 dispersed in the roller, the thickness and shape of the resilient member 43, and the insulation layer 44.

The construction of the pressure roller 50 will be described with reference to FIG. 2.

Referring to FIG. 2, the pressure roller 50 has a cylindrical metal shaft 51 with one end thereof grounded. The metal shaft 51 is covered with a resilient member 52 whose surface is covered with an insulation layer 53. Just like the resilient member 43 of the fixing roller 40, the resilient member 52 is formed of a rubber material such as silicone rubber and fluoro rubber. Just like the insulation layer 44 of the fixing roller 40, the insulation layer 53 is formed of an insulation material having a very low electrical conductivity, for example, fluororesin such as PFA (tetrafluoroethylene/perfluoroalxylvinylether).

Just as in the fixing roller 40, whiskers 54 of zinc oxide are in the shape of a tetrapod that extends in three dimensions. The whiskers 54 are electrically conductive and dispersed in the resilient member 52 and the insulation layer 53 such that the surface of the pressure roller 50 is electrically continuous to the metal shaft 51. The whiskers 54 are also dispersed at random on the surface of the insulation layer 44. Thus, the surface of the fixing roller 40 is maintained at the same potential as the metal pipe 42. In the first embodiment, the whisker 54 is not limited to the shape of a tetrapod but can be of any shape that extends in three dimensions.

Regular tetrahedrons, defined by four vertexes of the whisker 54, should preferably fill the resilient member 53 fully uniformly, so that the pressure roller 40 has a uniform electrical conductivity across the length of the pressure roller 50 between the surface of the pressure roller 50 and metal pipe 51.

A preferable amount of whisker 54 is in the range of $V\times10^6$ to $V\times10^{16}$ and more preferably in the range of $6V\times10^9$ to $9V\times10^{13}$, provided that the resilient member 53 has a volume of V (including the insulation layer 53). A most preferable amount of whisker 54 is in the range of $V\times10^9$ to $V\times10^{13}$.

As previously described, the length of fiber of the whisker 45 varies from 2 to 50 $\mu$m. A length of fiber of 2 $\mu$m provides an optimum value of $6V\times10^9$. A length of fiber of 50 $\mu$m of an optimum value of $9V\times10^{13}$. The range of $V\times10^6$ to $V\times10^{16}$ is an acceptable range taking into consideration variation in the amount of whisker 45 dispersed in the roller and thickness and shape of the resilient member 43 and the insulation layer 44.

Generally, the surfaces of a fixing roller and a pressure roller are covered with an insulation layer having a low electric conductivity in order to facilitate smooth peeling off of toner, i.e., to prevent "offset" problem. Use of an insulation layer having a high conductivity minimizes an image force. Image force is a force that acts on a charge when the charge approaches a metal surface. The image force attracts the charge to the metal surface.

In contrast, in order to remove excessive charges on the print medium, the surface of the roller should be electrically conductive or semiconductive such that the charges thereon are sufficiently dissipated. However, the existence of electrically conductive materials such as metal, carbon black, and graphite on the surface of the roller causes an image force that acts between the roller and the print medium P, thereby inducing offset of toner.

Figure 4:
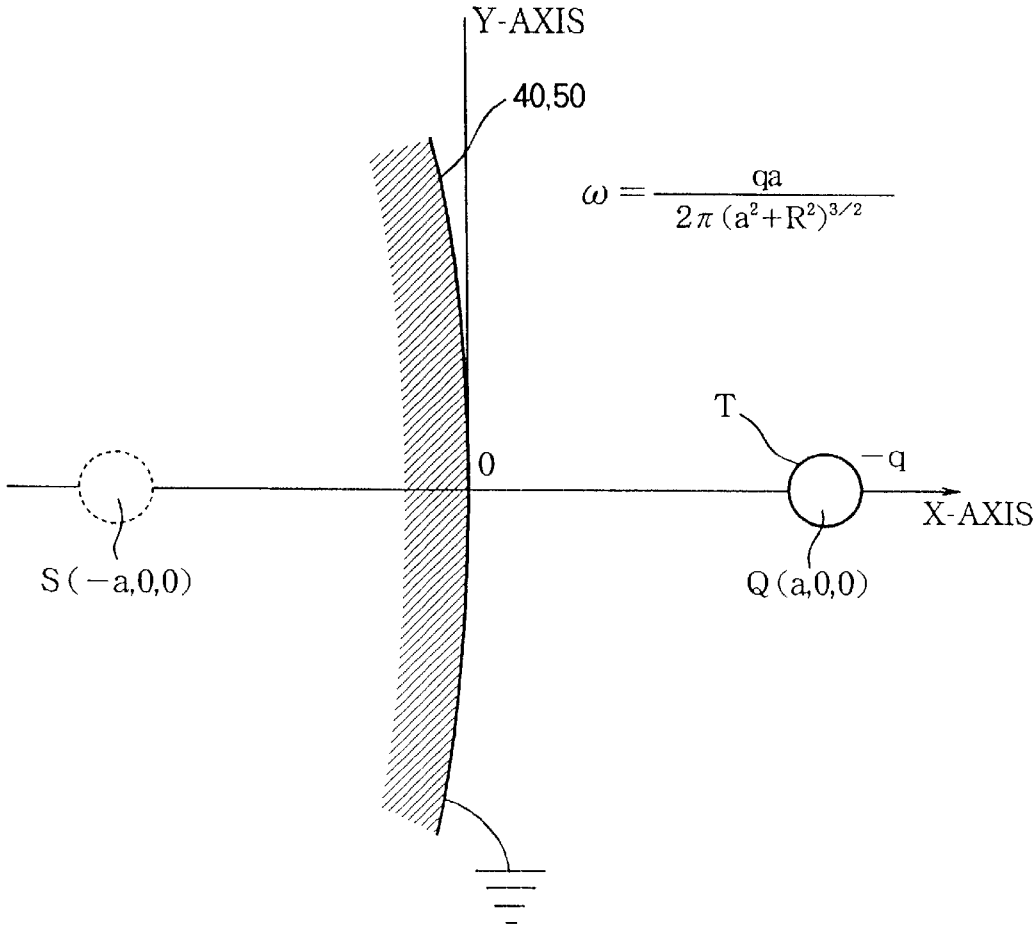
FIG. 4 illustrates an image force that is developed between the surface of an electrically conductive roller and the toner on the print medium P.

FIG. 4 illustrates an image force that is developed between the surface of an electrically conductive roller and the toner on the print medium P. It is assumed that the surface of the roller is made of a metal material. An amount ω of charge will be developed which has a density given by the following equation.

$$\omega=q\cdot a/(2\pi(a^2+R^2)^{3/2})$$

where -q (q>0) is an amount of charge on a spherical toner particle, a is a distance between the surface of the roller and the center of the toner particle, S and Q are positions away from the surface of the roller by the distance a, and R is a distance on the roller surface from the point O. Positions S and Q are located in a three dimensional space defined by X-, Y-, and Z-axis such that one is a mirror image of the other. The Z-axis is perpendicular to the page of FIG. 4.

Thus, the image force causes the surface of the roller 40 and 50 having electrical conductivity to attract a negatively charged toner T.

However, the resilient member 43 and the insulation layer 44 contain whiskers 45 dispersed therein and exposed on the surface of the insulation layer 44. Thus, the PFA resin fills most of the surface of the insulation layer 44 and the whiskers are sparse, facilitating effective peeling-off of toner T.

The whiskers 45 are dispersed such that the whiskers 45 are electrically continuous with one another. Thus, the surface of the fixing roller 40 and metal pipe 42 are of the same potential. Thus, when the toner image surface of the print medium P is brought into contact with the fixing roller 40, the charges on the toner image surface enter the resilient member 43 and reaches the metal pipe 42. Thus, the charges are dissipated. This prevents the offset of toner to the fixing unit 40.

With a conventional fixing roller whose surface is covered with an insulating material, it takes a long time for heat generated by a heat source to be transferred to the fixing roller because the insulating material has poor thermal conductivity. In contrast, the resilient member 43 of the fixing roller 40 of the invention contains whiskers 45 dispersed therein and therefore the heat generated by the heat source is transferred quickly through the whiskers 45 to the surface of the fixing roller 40. This allows temperature control of the heat source 41 in such a way that, for example, heat lost to the print medium P in contact with the fixing roller 40 can be quickly supplied. This leads to high-speed printing.

With the fixing roller 50, the insulation layer 53 and resilient member 52 contain the whiskers 54 therein. The PFA resin fills most of the surface of the fixing roller 40, and the whiskers are sparse, thereby facilitating effective peeling-off of toner T.

The whiskers 54 are dispersed in the resilient member 52 such that the whiskers 54 are electrically continuous with one another. Thus, the surfaces of the fixing roller 40 and metal pipe 42 are of the same potential. Thus, when the toner image surface of the print medium P is brought into contact with the fixing roller 40, the charges on the toner image surface enter the resilient member 43 and then reaches the metal pipe 42. Thus the charges are neutralized.

Thus, just like the neutralizing brush 18 located downstream of the transfer section and upstream of the fixing unit 36, the whiskers 54 neutralizes the charges deposited on the non-toner image surface of the print medium P. This prevents the offset of toner to the fixing unit 40.

If the leakage current that flows from the transfer roller 15 to the fixing roller 40 and pressure roller 50 becomes large enough to cause an offset problem, current limiting elements such as varistor 71 may be inserted between the ground and the metal pipe 42 and the metal shaft 51 of the pressure roller 50.

Second Embodiment

Figure 5:
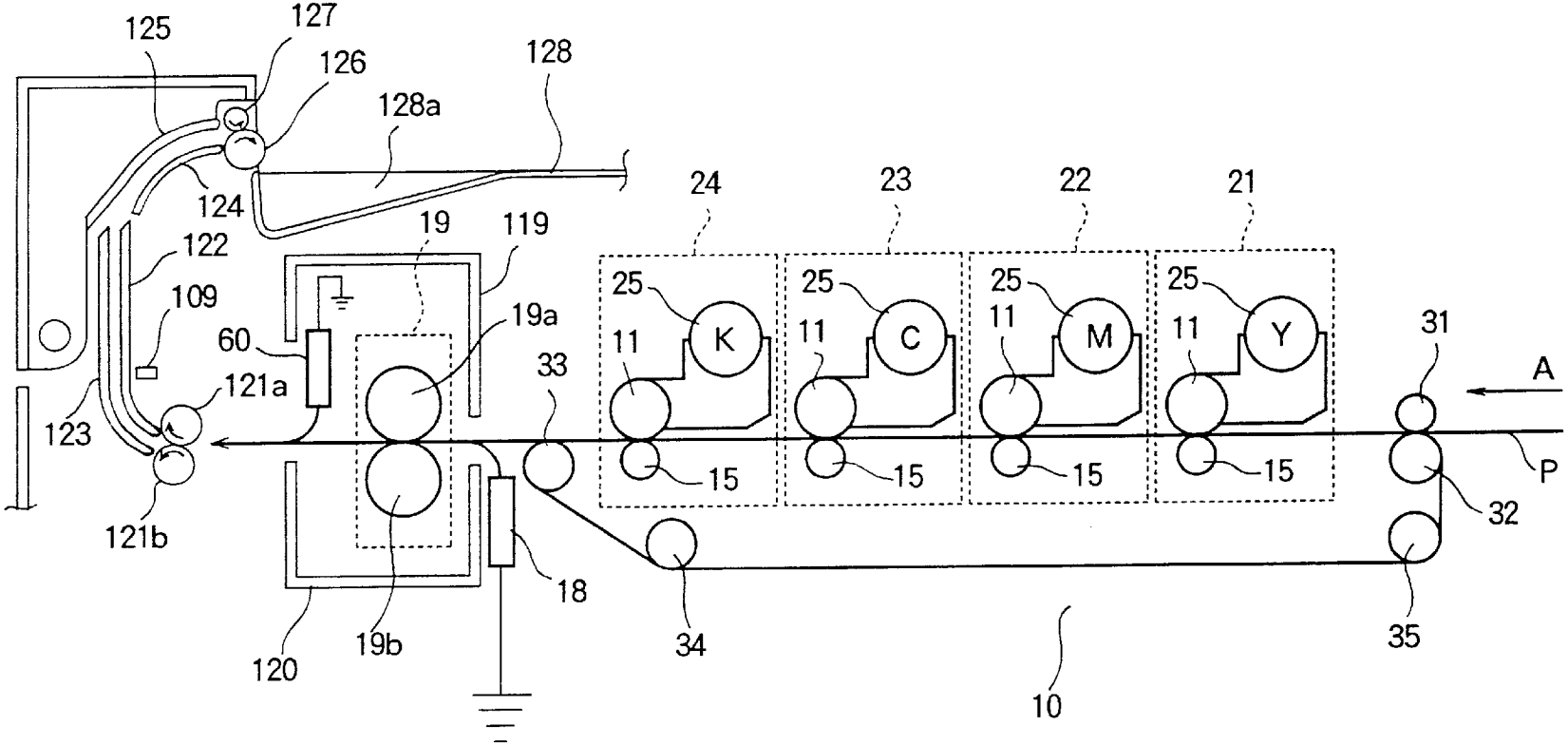
FIG. 5 illustrates a pertinent portion of an electrophotographic printer according to a second embodiment.

FIG. 5 illustrates a pertinent portion of an electrophotographic printer according to a second embodiment.

Referring to FIG. 5, the electrophotographic printer according to the second embodiment is of a conventional tandem type color printer. The color printer includes image-forming sections 21, 22, 23, and 24 for yellow, magenta, cyan, and black images, which are disposed along a path of a print medium P indicated by arrow A and operate to print images of corresponding colors on the image-carrying surface of the print medium.

A transport belt 10 is entrained about an attraction roller 32, drive roller 33, tension roller 34, and driven roller 35, and runs in the direction shown by arrow A between the photoconductive drums 11 and the transfer rollers 15 of the image forming sections 21–24. Another attraction roller 31 is disposed over the attraction roller 32 such that the transport belt 10 is sandwiched between the attraction rollers 31 and 32.

A potential difference exists between the attraction rollers 31 and 32. The potential difference creates dielectric polarization in the transport belt 10 and the print medium P that is transported on the transport belt 10. The dielectric polarization produces an electrostatic force so that the transport belt 10 attracts the print medium P. The transport belt 10 carries the print medium P thereon, passing through the transfer sections defined between the photoconductive drums 11 and the transfer rollers 15 of the respective image-forming sections 21–24. Thus, the toner images of the respective colors are transferred one over the other onto the print medium P as the print medium P passes through the respective transfer sections in sequence.

The transport belt 10 is made of, for example, a high resistance semiconductive plastic film. The resistance of the transport belt 10 is selected such that the transport belt 10 is charged to sufficiently attract the print medium P and neutralized by itself after the print medium P has left the transport belt 10.

When the print medium P reaches the drive roller 33, the transport belt 10 releases the print medium P. There is provided a neutralizing device, not shown, above the drive roller 33. The neutralizing device neutralizes the print medium P so that the print medium P is no longer electrostatically attracted to the transport belt 10 but is separated from the transport belt 10.

A neutralizing brush 18 is provided in the transport path of print medium downstream of a final one of the transfer sections defined between the photoconductive drum 11 for black and transfer roller 15. The free end of the neutralizing brush 18 is in contact with a non-toner image surface of the print medium P in order to neutralize the charges deposited on the non-toner image surface. The base portion of the neutralizing brush 18 is grounded.

Downstream of the neutralizing brush 18, there is provided a fixing unit 19 that includes a fixing roller 19*a* and a pressure roller 19*b*. The fixing roller 19*a* has a heat source, not shown, that supplies heat to the surface of the print medium P onto which a toner image has been transferred. The pressure roller 19*b* is disposed under the fixing roller 19*a* and presses the print medium P against the fixing roller 19*a*.

The fixing unit 19 is housed in an upper case 119 and a lower case 120. The fixing unit 19 may be of a conventional type, but the fixing unit 36 of the first embodiment will be very effective. The neutralizing brush 60 is mounted to a part of the upper case 119 and is located downstream of the fixing unit 19 in the transport path of the print medium P. The neutralizing brush 60 has a free end that contacts the toner image surface of the print medium P to remove the charges deposited on the toner image surface of the print medium P, and a base portion that is grounded.

The neutralizing brush 60 is preferably disposed as close to a nip defined between the fixing roller 19*a* and the pressure roller 19*b* as possible. The shorter the distance between the neutralizing brush 60 and the nip, the more effectively the neutralizing brush 60 begins to neutralize the print medium P from the forward end of the print medium P to effectively prevent the offset problem. The fixing roller 19*a* and pressure roller 19*b* have finite dimensions and therefore the neutralizing brush 60 is disposed such that the free end of the neutralizing brush 60 contacts the print medium P about 30 mm downstream of the nip.

As described previously, the non-toner image surface of the print medium P that enters the fixing unit 19 has been subjected to positive dielectric polarization and the toner image surface of the print medium P has been subjected to negative dielectric polarization. The charges deposited on the non-toner image surface of the print medium P are easily dissipated by the brush 18, pressure roller 19*b*, and the frame and chassis of the printer. However, the charges on the image carrying surface and charges on the non-toner image surface are opposite in polarity and the same in amount, and therefore the charges on the respective surfaces of the print medium P cannot easily be removed.

Providing the neutralizing brush 60 downstream of the fixing unit 36 in addition to the brush 18 allows eliminating of the charges on the both surfaces of the print medium P in equilibrium condition. Eliminating the charges with the neutralizing brush 60 reduces the potential difference between the fixing roller 40 and the print medium P, thereby effectively preventing the offset of the toner carried on the toner image surface of the print medium P.

Figure 6A:
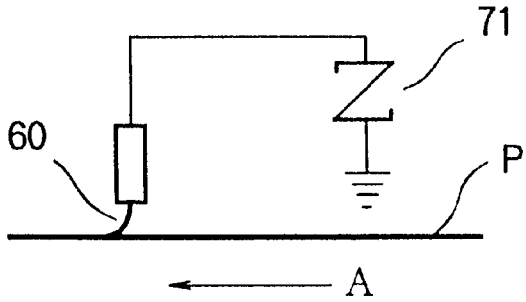
FIGS. 6A–6C illustrate the neutralizing brush that is connected to the ground through a varistor, a Zener diode, and a resistor.
Figure 6B:
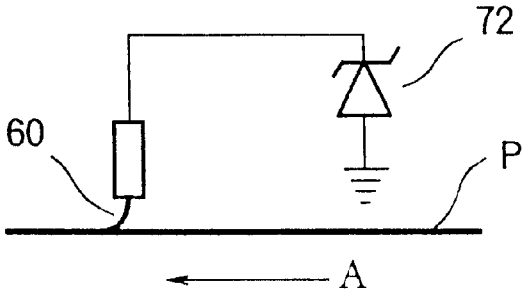
Figure 6C:
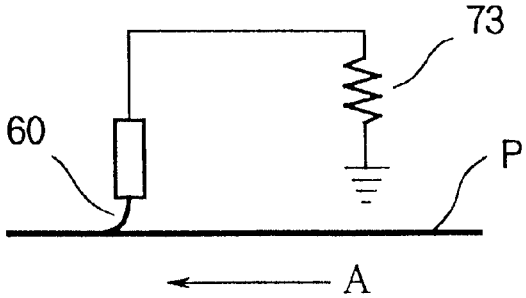

FIGS. 6A–6C illustrate cases when the neutralizing brush 60 is grounded through a varistor, a Zener diode, and a resistor, respectively. Arrows A indicate the direction of travel of the print medium P.

If a large leakage current flows from, for example, the transfer roller 15 to the neutralizing brush 60 to cause the offset problem of toner image, the neutralizing brush 60 may be grounded through a varistor 71 (FIG. 6A) to limit the current that flows through the neutralizing brush 60. Altenatively, the neutralizing brush 60 may be grounded through a Zener diode 72 (FIG. 6B) or a resistor 73 (FIG. 6C) instead of the varistor in order to limit current. Limiting the current prevents noise from being generated and offers a reliable printer.

A pair of transport rollers 121*a* and 121*b* is disposed downstream of the neutralizing brush 60. After the print medium P has passed the neutralizing brush 60, the transport rollers 121*a* and 121*b* advance the print medium P through the guides 122–125 to discharge rollers 126 and 127. The print medium P is then further advanced by the discharge rollers 126 and 127 to an upper stacker 128*a* defined on a part of an upper cover 128. A photo sensor 109 detects a rearward end of the print medium.

Third Embodiment

Figure 7:
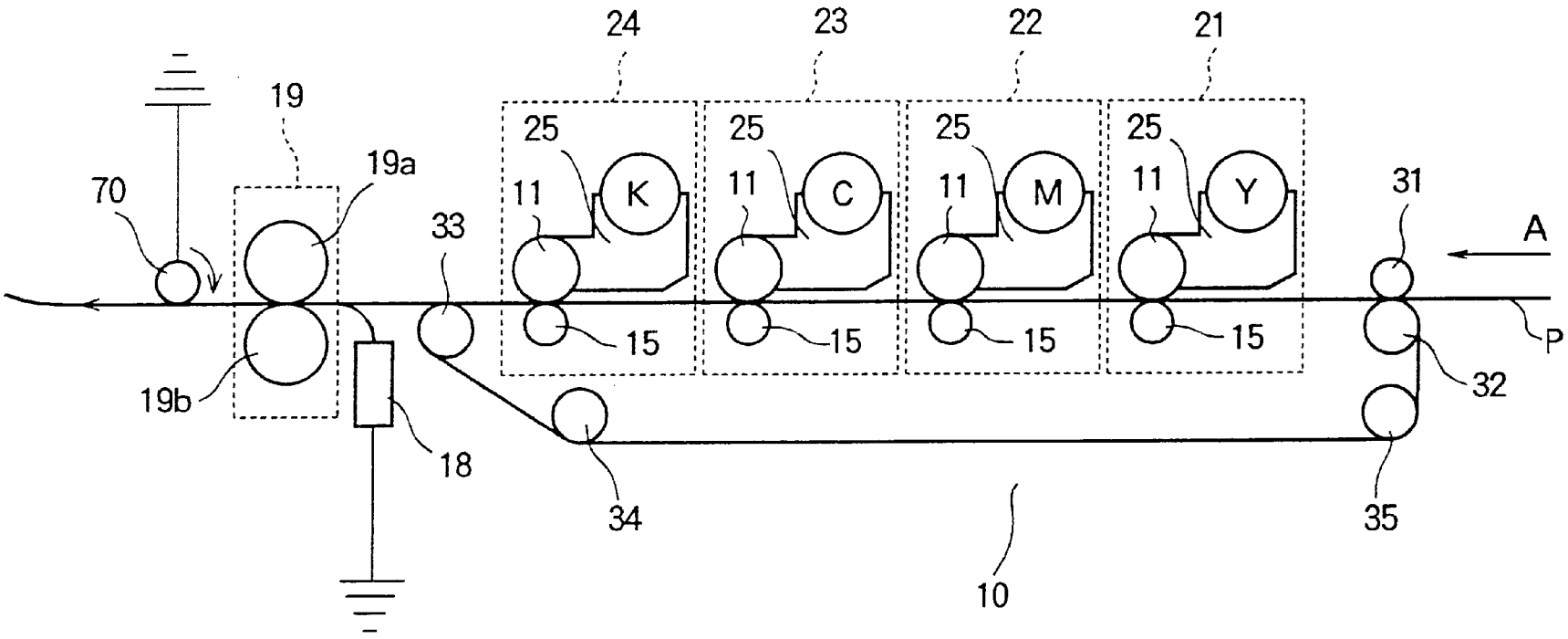
FIG. 7 illustrates a pertinent portion of an electrophotographic printer according to a third embodiment.

FIG. 7 illustrates a pertinent portion of an electrophotographic printer according to a third embodiment.

Referring to FIG. 7, the electrophotographic printer according to the third embodiment differs from the second embodiment in that the neutralizing roller 70 is used in place of the neutralizing brush 60 and brought into contact with the toner image surface of the print medium P. The neutralizing roller 70 is grounded. Just as in the neutralizing brush 60, the neutralizing roller 70 should be as close to the nip defined between the fixing roller 40 and the pressure roller 50 as possible.

The neutralizing brush 60 according to the second embodiment deteriorates over time due to the friction between the print medium P and the neutralizing brush 60. The neutralizing roller 70 is not driven in rotation by any drive means and is freely rotatable such that when the print medium P is advanced, the neutralizing roller 70 rotates in rolling contact with the print medium P. Thus, the neutralizing roller 70 does not impose a drag on the print medium P and therefore the neutralizing roller 70 need not be replaced for a new, unused one during the lifetime of the printer. In other words, the neutralizing roller 70 is maintenance free.

Fourth Embodiment

Figure 8:
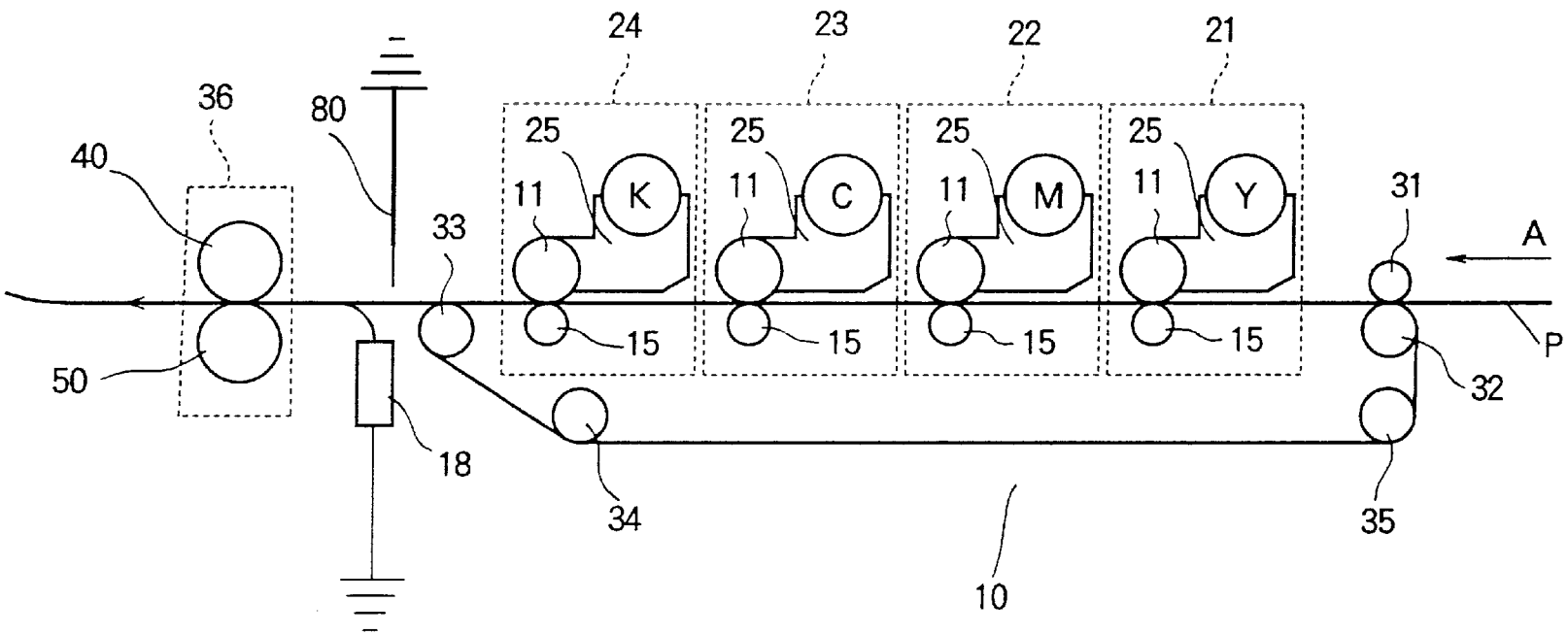
FIG. 8 illustrates a pertinent portion of an electrophotographic printer according to a fourth embodiment.

FIG. 8 illustrates a pertinent portion of an electrophotographic printer according to a fourth embodiment.

Referring to FIG. 8, the fourth embodiment differs from the first embodiment in that a neutralizing member 80 is added to the electrophotographic printer of FIG. 3.

The neutralizing member 80 is in the shape of a metal rod having a sharp point. The neutralizing member 80 is disposed downstream of the transfer section for black image and upstream of the fixing unit 36, and connected to the ground. The neutralizing member 80 is mounted such that the sharp point is very close to the toner image surface of the print medium P when the print medium P passes under the neutralizing member 80.

When the print medium P with a toner image transferred thereon passes the neutralizing member 80, electrostatic induction creates charges on the sharp point of the neutralizing member 80, the charges being opposite in polarity to those deposited on the toner image surface of the print medium P. Attraction is developed between the negative charges on the toner image surface of the print medium P and the positive charges on the sharp point of the neutralizing member 80.

Therefore, when the toner image surface of the print medium P is excessively charged, a discharge occurs between the sharp point of the neutralizing member 80 and the toner image surface, reducing the negative charges on the toner image surface. A decrease in charge reduces the potential difference between the fixing roller 40 and the printed medium P, thereby effectively preventing the offset of the toner T deposited on the toner image surface of the print medium P to the fixing roller 40.

Fifth Embodiment

Figure 9:
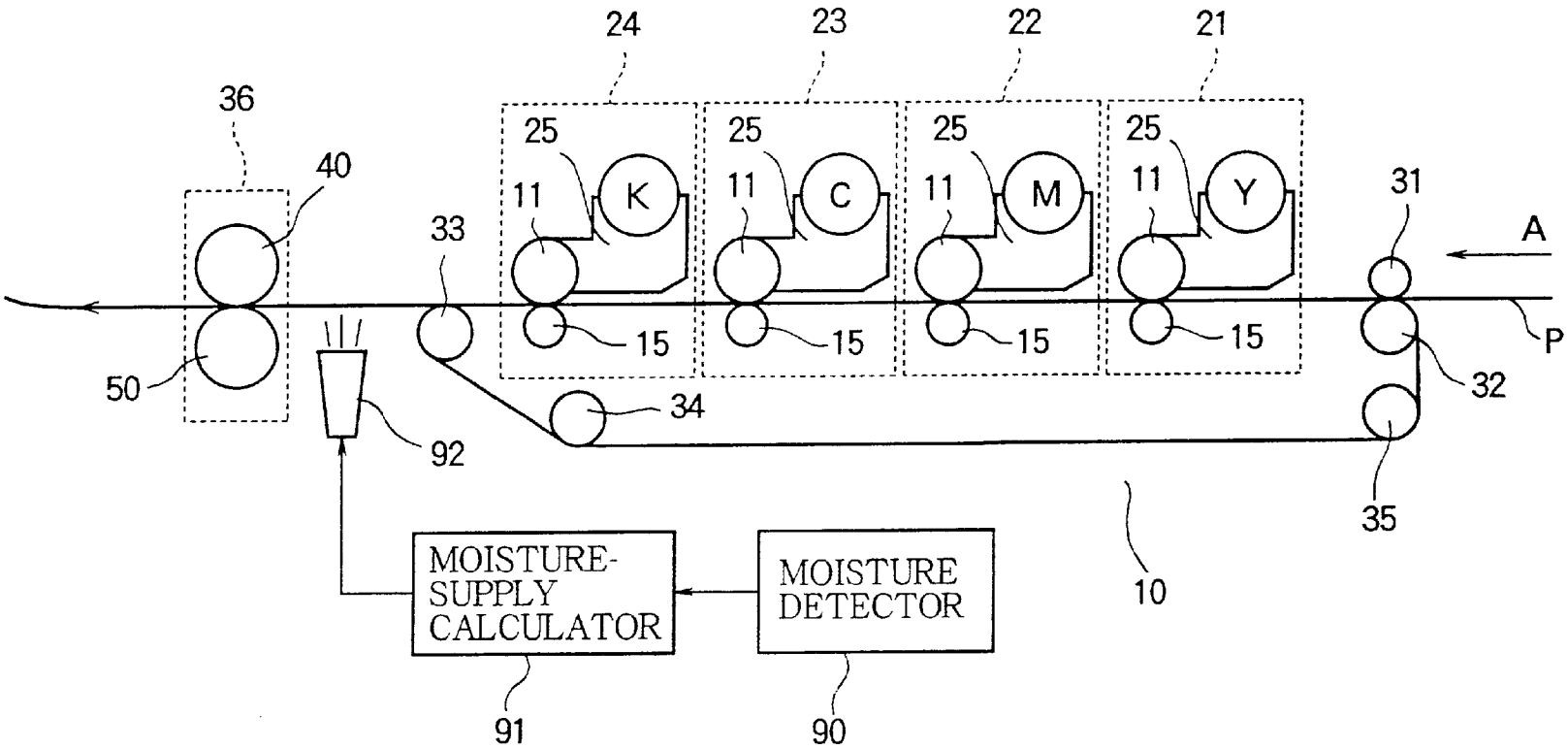
FIG. 9 illustrates a pertinent portion of an electrophotographic printer according to a fifth embodiment.
Figure 11:
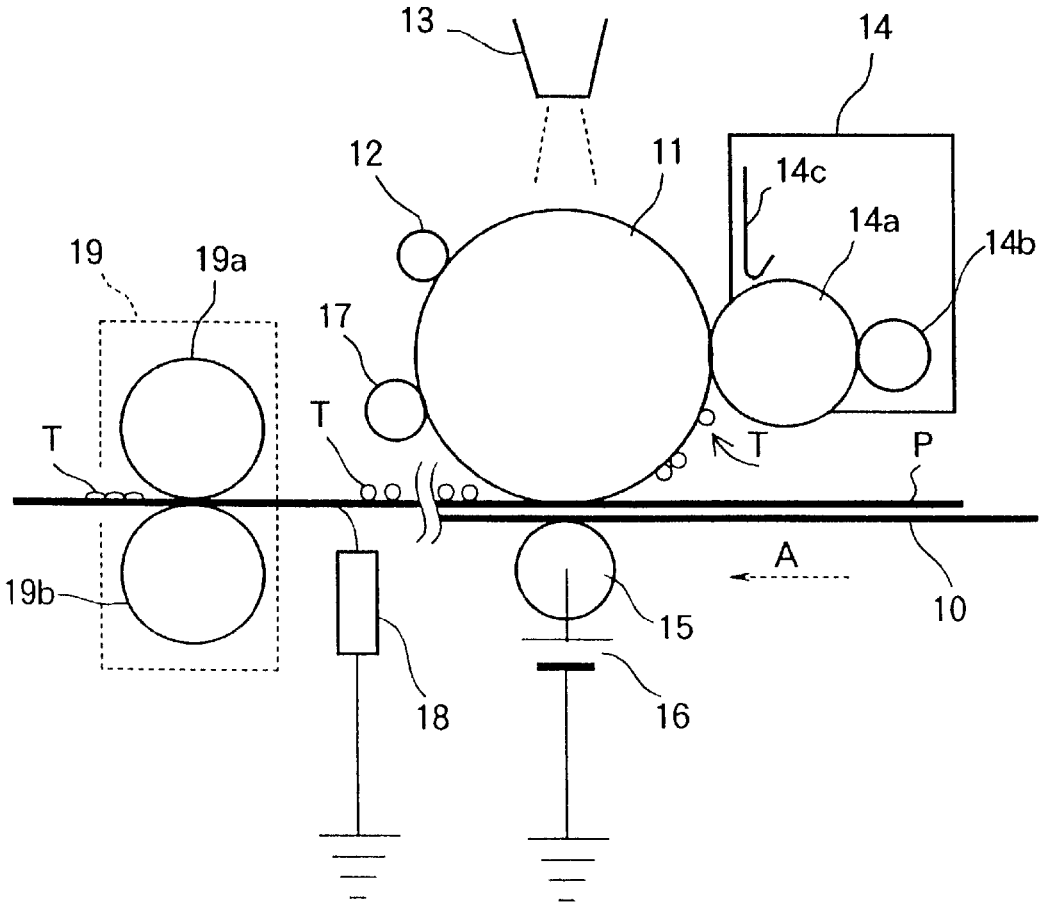
FIG. 11 Prior Art
FIG. 11 illustrates a relevant portion of a conventional electrophotographic printer.
Figure 12:
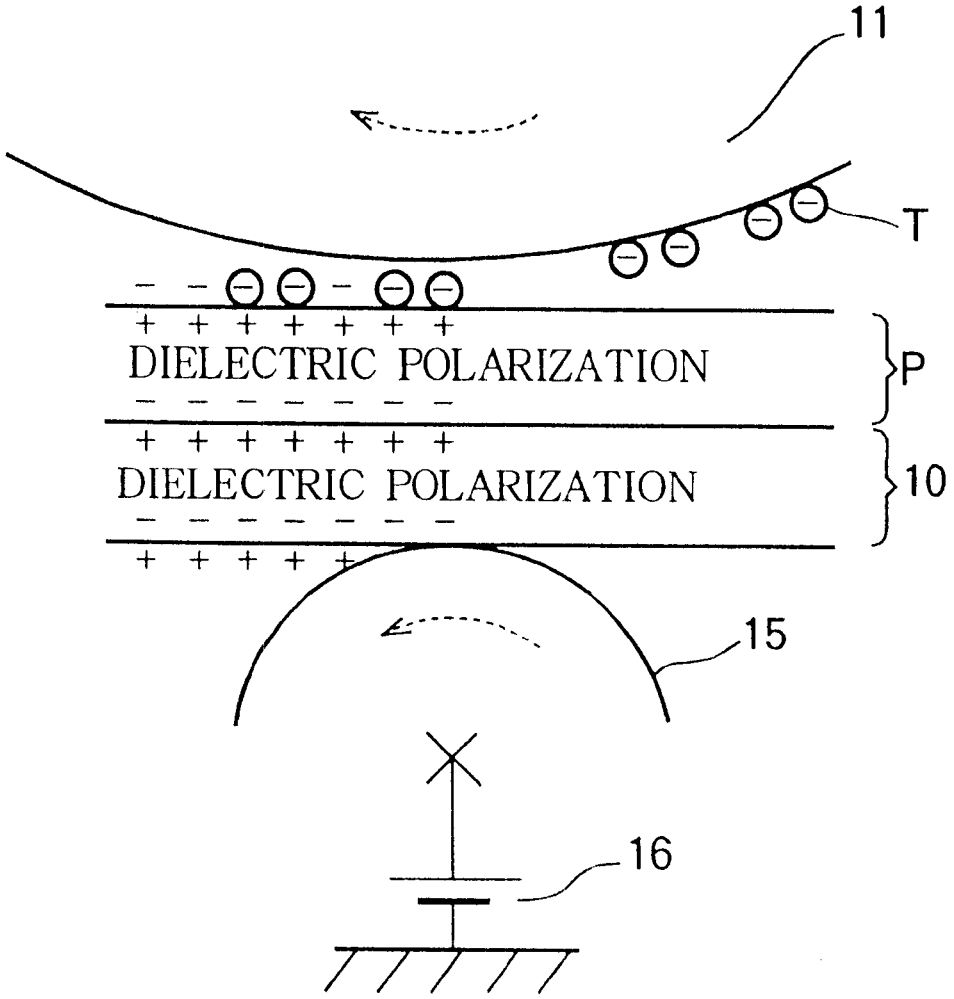
FIG. 12 illustrates a mechanism in which a toner image formed on a photoconductive drum is transferred onto a print medium.

FIG. 9 illustrates a pertinent portion of an electrophotographic printer according to a fifth embodiment.

The fifth embodiment differs from the first embodiment in that a humidifier 92 is provided in place of the neutralizing member 18 and a moisture detector 90 and a moisture-supply calculator 91 are added.

The print medium P contains less moisture therein when the print medium P is placed in a low humidity environment, and therefore the print medium P has good insulation such that both the toner image surface and the non-toner image surface of the print medium P are apt to be at high potential. As is clear from FIG. 10, the moisture in the air is determined by the temperature and humidity.

An experiment conducted for various values of humidity at a temperature of 20° C. revealed that the offset problem was not observed when the absolute humidity was higher than 70%. It is considered that if the moisture in the air is more than 10 g/m$^3$, the electrostatic polarization of the water molecules contained in the print medium P dissipates excessive charges on the toner image surface and non-toner image surface of the print medium P to prevent the offset of toner at the fixing unit 36. For example, the dielectric constant of water is about 80 times that of vacuum.

The moisture detector 90 detects the temperature and humidity of the air surrounding the print medium P and determines an amount of moisture in the air using the table of FIG. 10 that list moisture values for humidity values. In accordance with the moisture in the air detected by the moisture detector 90, the moisture-supply calculator 91 determines an amount of moisture required for increasing the moisture content in the print medium P to a value higher than 10 g/m$^3$.

The humidifier 92 is disposed downstream of the transfer section for black image and upstream of the fixing unit 36. The humidifier 92 humidifies the toner image surface of the print-medium P to supply an amount of moisture determined by the moisture-supply calculator 91. If the moisture in the air detected by the moisture detector 90 is more than 10 g/m$^3$, then the amount of moisture calculated by the moisture-supply calculator 91 is 0 g/m$^3$. Thus, the humidifier 92 does not humidify.

Thus, in the fifth embodiment, the print medium P is humidified such that the moisture content is more than 10 g/m$^3$. Therefore, the excessive charge will be dissipated so that the offset problem nof toner at the fixing unit 36 is effectively prevented.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. An electrographic printer, comprising:

a fixing unit, wherein the fixing unit includes:

a fixing roller having a heat source that generates heat for fusing a toner image transferred by a transfer unit onto a first surface of a print medium; and a pressure roller in pressure engagement with the fixing roller; and a neutralizing unit that is disposed downstream of the fixing unit in proximity to the fixing unit, and neutralizes the first surface by coupling the first surface to a ground potential;

wherein at least one of said fixing roller and said pressure roller includes a resilient member that covers a metal shaft and an insulation layer that covers the resilient member, said resilient member containing electrically conductive whiskers that extend radially in three dimensions, the whiskers being dispersed such that a surface of the insulation layer and a surface of the metal shaft are electrically continuous with each other.

2. The electrophotographic printer according to claim 1, wherein said fixing roller includes said resilient member and said insulation layer.

3. The electrophotographic printer according to claim 1, wherein said pressure roller includes said resilient member and said insulation layer.

4. The electrophotographic printer according to claim 1, wherein each of said fixing roller and said pressure roller includes said resilient member and said insulation layer.

5. The electrophotographic printer according to claim 1, wherein the neutralizing unit comprises one of a neutralizing roller and a neutralizing brush that is disposed downstream of the fixing unit and neutralizes the first surface.

6. An electrophotographic printer, comprising:

a fixing unit, wherein the fixing unit includes:

a fixing roller having a heat sorce that generates heat for fusing a toner image transferred by a transfer unit onto a first surface of a print medium; and a pressure roller in pressure engagement with the fixing roller;

wherein at least one of said fixing roller and said pressure roller includes a resilient member that covers a metal shaft and an insulation layer that covers the resilient member, said resilient member containing electrically conductive whiskers that extend radially in three dimensions, the whiskers being dispersed such that a surface of the insulation layer and a surface of the metal shaft electrically continuous with each other; and a metal rod that has a sharp point and is disposed downstream of the transfer unit, wherein when the print medium advances from the transfer unit to the fixing unit, the sharp point is in proximity to the first surface of the print medium to neutralize excessive charges deposited on the first surface.

7. An electrophotographic printer, comprising:

a fixing unit, wherein the fixing unit includes:

a fixing roller having a heat source that generates heat for fusing a toner image transferred by a transfer unit onto a first surface of a print medium; and a pressure roller in pressure engagement with a fixing roller;

wherein at least one of said fixing roller and said pressure roller includes a resilient member that covers a metal shaft and an insulation layer that covers the resilient member, said resilient member containing electrically conductive whiskers that extend radially in three dimensions, the whiskers being dispersed such that a surface of the insulation layer and a surface of the metal shaft are electrically continuous with each other;

a moisture detector that detects a first amount of moisture in the air;

a moisture-supply calculator that determines a second amount of moisture that should be given to the print medium, the second amount of moisture being determined on the basis of the first amount of moisture; and a humidifier disposed downstream of the transfer unit and upstream of said fixing unit, said humidifier supplying the second amount of moisture to a second surface of the print medium opposite to the first surface.

8. An electrophotographic printer, comprising:

a fixing unit; and a neutralizing unit that is disposed in a transport path of a print medium;

wherein said neutralizing unit is disposed downstream of the fixing unit and neutralizes a charged surface of the print medium exiting the fixing unit, said neutralizing unit being disposed on a side of a first surface of the print medium on which a toner image is transferred.

9. The electrophotographic printer according to claim 8, wherein the fixing unit includes:

a fixing roller having a heat sorce that generates heat for fusing a toner image; and a pressure roller in pressure engagement with said fixing roller to form a nip between said fixing roller and said pressure roller.

10. The electrophotographic printer according to claim 8, wherein said neutralizing unit is disposed in proximity to the fixing unit.

11. The electrophotographic printer according to claim 10, wherein said neutralizing unit is disposed to oppose the first surface of the print medium on which the toner image is transferred.

12. The electrophotographic printer according to claim 10, wherein said neutralizing unit is a neutralizing brush.

13. The electrophotographic printer according to claim 10, wherein said neutralizing unit is a neutralizing roller.

14. The electrophotographic printer according to claim 8, wherein said neutralizing unit is brought into contact with the print medium when the print medium is discharged from the fixing unit.

15. The electrophotographic printer according to claim 14, wherein said neutralizing unit is connected to a ground through a current limiting element.

16. The electrophotographic printer according to claim 15, wherein the current limiting element is any one of a varistor, zener diode, and a resistor.

17. The electrophotographic printer according to claim 8, wherein another neutralizing unit is disposed upstream of the fixing unit and downstream of a transfer unit.

18. An electrophotographic printer, comprising a neutralizing unit disposed upstream of a fixing unit and downstream of a transfer unit, said neutralizing unit being disposed on a side of a print medium having a surface on which a toner image is transferred.

19. The electrophotographic printer according to claim 18, wherein said neutralizing unit is kept from contacting with the surface.

20. The electrophotographic printer according to claim 19, wherein said neutralizing unit is a metal rod having a sharp-pointed end.

* * * * *